US007372214B2

(12) United States Patent
Song et al.

(10) Patent No.: US 7,372,214 B2
(45) Date of Patent: May 13, 2008

(54) APPARATUS AND METHOD FOR DRIVING LAMP OF LIQUID CRYSTAL DISPLAY DEVICE

(75) Inventors: Jae Hun Song, Seoul (KR); Jae Kyung Kang, Kumi-shi (KR); Dong Yun Lee, Sungnam-shi (KR); Jae Ho Lee, Daegu (KR)

(73) Assignee: LG. Philips LCD Co., Ltd, Seoul (KR)

( * ) Notice: Subject to any disclaimer, the term of this patent is extended or adjusted under 35 U.S.C. 154(b) by 25 days.

(21) Appl. No.: 11/013,871

(22) Filed: Dec. 16, 2004

(65) Prior Publication Data

US 2005/0127851 A1 Jun. 16, 2005

(30) Foreign Application Priority Data

Dec. 16, 2003 (KR) ..... 10-2003-0091801

(51) Int. Cl.
*G05F 1/00* (2006.01)

(52) U.S. Cl. ..... 315/291; 315/224; 315/308; 315/294; 315/325; 315/225; 315/209 R

(58) Field of Classification Search ..... 315/224–226, 315/276–277, 291, 294, 307–308, 209 R, 315/194–199, 324, 325; 324/414, 512, 536
See application file for complete search history.

(56) References Cited

U.S. PATENT DOCUMENTS 6,087,776 A * 7/2000 Yamashita et al. ..... 315/82
6,294,879 B1 9/2001 Nagase et al. ..... 315/209 R
6,420,839 B1 * 7/2002 Chiang et al. ..... 315/311
6,495,972 B1 * 12/2002 Okamoto et al. ..... 315/291
6,504,315 B2 * 1/2003 Kim ..... 315/224
6,670,781 B2 * 12/2003 Weindorf ..... 315/307
6,737,868 B2 * 5/2004 Takagi ..... 324/414
6,794,832 B2 * 9/2004 Yamamoto et al. ..... 315/307
6,922,023 B2 * 7/2005 Hsu et al. ..... 315/291
6,979,957 B2 * 12/2005 Lee et al. ..... 315/195

(Continued)

FOREIGN PATENT DOCUMENTS

DE 3811516 4/1989

(Continued)

OTHER PUBLICATIONS

Office Action dated Apr. 25, 2007 for corresponding Japanese Patent Application No. 2004-363857.

*Primary Examiner*—Haissa Philogene
(74) *Attorney, Agent, or Firm*—Brinks Hofer Gilson & Lione

(57) ABSTRACT

A lamp driving apparatus of a liquid crystal display includes a plurality of lamps arranged with a predetermined distance between adjacent lamps; a comparator to compare output voltages of lamps that are separated by more than the lamp distance; and a power interceptor to cut off the power supply of a lamp where mis-discharge is generated, in accordance with a comparison result of the comparator. A lamp driving method of a liquid crystal display which includes: comparing a designated reference voltage with lamp output voltages, and intercepting the power supply of the lamp of which the output voltage is different from the reference voltage to stop mis-discharge between lamps.

14 Claims, 11 Drawing Sheets

U.S. PATENT DOCUMENTS

2003/0085711 A1 5/2003 Takagi ..... 324/414

FOREIGN PATENT DOCUMENTS

JP 05-283189 10/1993
JP H07-169584 7/1995
JP H08-213184 8/1996
JP 2000-197368 7/2000
JP 2002-252094 9/2000

* cited by examiner

APPARATUS AND METHOD FOR DRIVING LAMP OF LIQUID CRYSTAL DISPLAY DEVICE

This application claims the benefit of the Korean Patent Application No. P2003-91801 filed on Dec. 16, 2003, which is hereby incorporated by reference.

FIELD

The present application relates to a liquid crystal display device, and more particularly to an apparatus and method of driving a lamp of a liquid crystal display device.

BACKGROUND

The range of applications of liquid crystal displays (hereinafter, referred to as "LCD") is gradually broadening due to characteristics such as light weight, thinness and low power consumption. The LCD is used in office automation equipment, audio/video devices and similar applications. The LCD displays a desired picture on a screen by controlling the amount of transmitted light in accordance with a video signal applied to a plurality of control switches which are arranged in a matrix configuration.

The LCD needs a light source like a backlight because it is not a self-luminous display device. A cold cathode fluorescent lamp (hereinafter, referred to as "CCFL") may be used as the light source in the backlight.

A CCFL is a light source tube using cold emission phenomenon; electrons are emitted because a strong electric field is applied to the surface of a cathode, so that low heat generation, high brightness, long life span and full colorization are obtained. The CCFL can be of light guide system, direct illumination system or reflection plate system, and a light source tube is adopted in accordance with the design requirements of the LCD.

The CCFL uses an inverter circuit to produce a high-voltage power from a low voltage DC power source.

Referring to FIGS. 1 and 2, the lamp driving apparatus of an LCD includes a lamp housing 10 into which a plurality of lamps 12 are put; an inverter part 22 with a plurality of inverters for supplying an output voltage to each of the lamps 12; a first printed circuit board 20 on which the inverter part 22 is mounted; a lamp protector 32 for protecting each of the lamps 12; and a second printed circuit board 30 on which the lamp protector 32 is mounted.

The lamp housing 10 has a space provided for receiving the lamps and is disposed on a main support (not shown).

Each lamp receives the lamp output voltage from the inverter part 22 and illuminates a liquid crystal display panel (not shown) with visible light.

The first printed circuit board 20 is arranged at one side of the support main (not shown) and folded to the direction of the rear surface of the support main.

The second printed circuit board 30 is arranged at one side of the support main (not shown) and folded to the direction of the rear surface of the support main.

As shown in FIG. 2, each inverter 24 constituting the inverter part 22 includes a switching circuit 26 to switch a voltage from a voltage source Vin in response to a switching control signal, and a transformer 28 to convert the voltage supplied by switching of the switching circuit 26 into an output voltage.

The switching circuit 26 switches the voltage from the voltage source Vin to the transformer 28 in response to the switching control signal from a pulse width modulator PWM 34. For this purpose, the switching circuit 26 includes at least one switching device.

The transformer 28 includes a primary winding wire connected to the switching circuit 26 and a secondary winding wire connected to the lamp 12. Both ends of the primary winding wire are connected to the switching circuit 26 and one end of the secondary winding wire is connected to a first electrode terminal of the lamp 12, and the other end is connected to a ground (GND). The transformer 28 converts the voltage supplied to the primary winding wire by a winding ratio of primary and secondary winding wires and induces it in the secondary winding wire. The voltage induced on the secondary winding wire is supplied to the lamp 12 through a first electrode terminal and lights the lamp 12.

The lamp protector 32 includes an open lamp protector OLP 36 to detect the presence or absence of the lamp 12 by the output voltage of the lamp 12; an over voltage protector OVP 38 to detect the voltage supplied to the electrode part of the lamp from the transformer 28; and a pulse width modulator 34 for switching the switching circuit 26 in response to a feedback signal FB2 from the over voltage protector 38.

The open lamp protector 36 detects the presence or absence of the lamp 12 by the output voltage of the lamp 12 to control the pulse width modulator 34. That is, in the case that the lamp 12 is not present, the open lamp protector 36 generates a feedback signal FB1 corresponding to the detected detection signal. In this circumstance, the pulse width modulator 34 inhibits the switching circuit 26 such that the voltage from the voltage source Vin is not supplied to the transformer 28, in accordance with a feedback signal FB1 from the open lamp protector 36. Thus, in case that the lamp 12 is not present, the inverter part 22 does not supply the voltage to the lamp 12.

The over voltage protector 38 detects the voltage supplied to the electrode part of the lamp 12 from the transformer 28 to control the pulse width modulator 34. That is, as shown in FIG. 3, when an over voltage V2 of not less or more than voltage levels OVP1, OVP2, respectively, which would cause damage to the lamp 12 is supplied to the electrode part of the lamp 12 from the transformer 28, the over voltage protector 38 generates the feedback signal FB2 corresponding to the detected detection signal and supplies the generated signal to the pulse width modulator 34. In this circumstance, the pulse width modulator 34 controls the switching period of the switching circuit 26 by the feedback signal FB2 from the over voltage protector 38 to reduce the voltage supplied to the primary winding wire of the transformer 28 from the voltage source Vin. Thus, the voltage supplied to the lamp 12 from the secondary winding wire of the transformer 28 is reduced to V3 to prevent the lamp 12 from being damaged.

The pulse width modulator 34 controls the switching period of the switching circuit 26 in response to the feedback signal FB2 from the over voltage protector 38 and the feedback signal FB1 from the open lamp protector 36. That is, the pulse width modulator 34 controls the voltage supplied to the transformer 28 by controlling the switching period of the switching device, which constitutes the switching circuit 26 in response to the feedback signals FB1, FB2.

In the lamp driving device of the LCD, the lamp lighting voltage and the operating voltage required by the lamp 12 is directly proportional to the length of the glass tube of the lamp 12. As the voltage increased in this way, as shown in FIG. 4, it can generate an undesired mis-discharge between adjacent lamps 12 and render the output voltage of the inverter 24 unstable.

Hence, the lamp driving apparatus of the existing LCD designs can cause the lamps 12 to be damaged because no protective circuit is provided for responding to the mis-discharge that occurs between the adjacent lamps 12.

SUMMARY

The present application discloses an apparatus and method of driving lamps of a liquid crystal display device that is adaptive for improving the reliability and stability of a lamp electrode part.

A lamp driving apparatus of a liquid crystal display includes a plurality of lamps arranged with a designated lamp distance between adjacent lamps; a comparator unit to compare output voltages of lamps that are separated by a distance further than the lamp distance; and a power interrupter to cut off the power supply to a lamp where mis-discharge is generated, in accordance with a comparison result of the comparator unit.

In the lamp driving apparatus, the comparator unit may compare the output voltage between the lamps arranged at even-numbered locations among the lamps. The comparator unit may also compare the output voltage between the lamps arranged at odd-numbered locations among the lamps.

The comparator unit includes: a first comparator of which a first terminal receives the output voltage of any first one of the lamps and a second terminal receives the output voltage of another lamp that is not adjacent to the first lamp; a second comparator of which a third terminal receives the output voltage inputted to the second terminal of the first comparator and a fourth terminal receives the output voltage inputted to the first terminal of the first comparator; a first diode installed between the output of the first comparator and the power interrupter; a second diode installed at the first terminal of the first comparator; a third diode installed between the output of the second comparator and the power interrupter; a fourth diode installed at the third terminal of the second comparator; a driving power source to drive the comparators and the power interrupter; a first resistor installed between the driving power source and output of the first comparator; and a second resistor installed between the driving power source and the output of the second comparator.

The lamp driving apparatus further includes: an inverter to supply a driving voltage to the lamps; an open lamp protector to detect the presence or absence of each of the lamps by the output voltage of the lamps; and an over voltage protector to detect an over voltage supplied to each of the lamps by the output voltage of the lamps.

The inverter includes: a transformer to convert a voltage from a voltage source to the driving voltage, and a switching circuit to switch the voltage to the transformer.

The power interrupter includes: a signal generator to generate a feedback signal in accordance with the comparison result of the comparator unit; and a pulse width modulator to control the switching period of the switching circuit by the feedback signal of the signal generator, the open lamp protector and the over voltage protector.

The signal generator includes: a third resistor installed between the comparators and ground; a transistor installed between the driving power source and ground to operate in accordance with the comparison result of the comparator unit; and a fourth resistor installed between the transistor and the driving voltage source.

A lamp driving apparatus of a liquid crystal display according to another aspect of the present invention includes a plurality of lamps; a comparator to compare a reference voltage with output voltages of the lamps; and a power interrupter that cuts off the power supply of the lamp whose output voltage is different from the reference voltage to stop mis-discharge between adjacent lamps. The reference voltage may be an output from the power supply.

A lamp driving method of a liquid crystal display wherein a plurality of lamps are arranged with a predetermined lamp distance between adjacent lamps to be driven, includes: comparing output voltages between lamps which are separated by more than the predetermined lamp distance; and interrupting the power supply of the lamp where mis-discharge is generated, in accordance with the comparison result.

In the lamp driving method, the comparison step may compare the output voltages between the lamps arranged at even-numbered locations among the lamps. The comparison step also may compare the output voltages between the lamps arranged at odd-numbered locations among the lamps.

A lamp driving method of a liquid crystal display wherein a plurality of lamps are driven includes: comparing a designated reference voltage with lamp output voltages; and interrupting the power supply of the lamp whose output voltage is different from the reference voltage, to stop mis-discharge between adjacent lamps.

DETAILED DESCRIPTION

Exemplary embodiments may be better understood with reference to the drawings, but these embodiments are not intended to be of a limiting nature. Like numbered elements in the same or different drawings perform equivalent functions.

Figure 5:
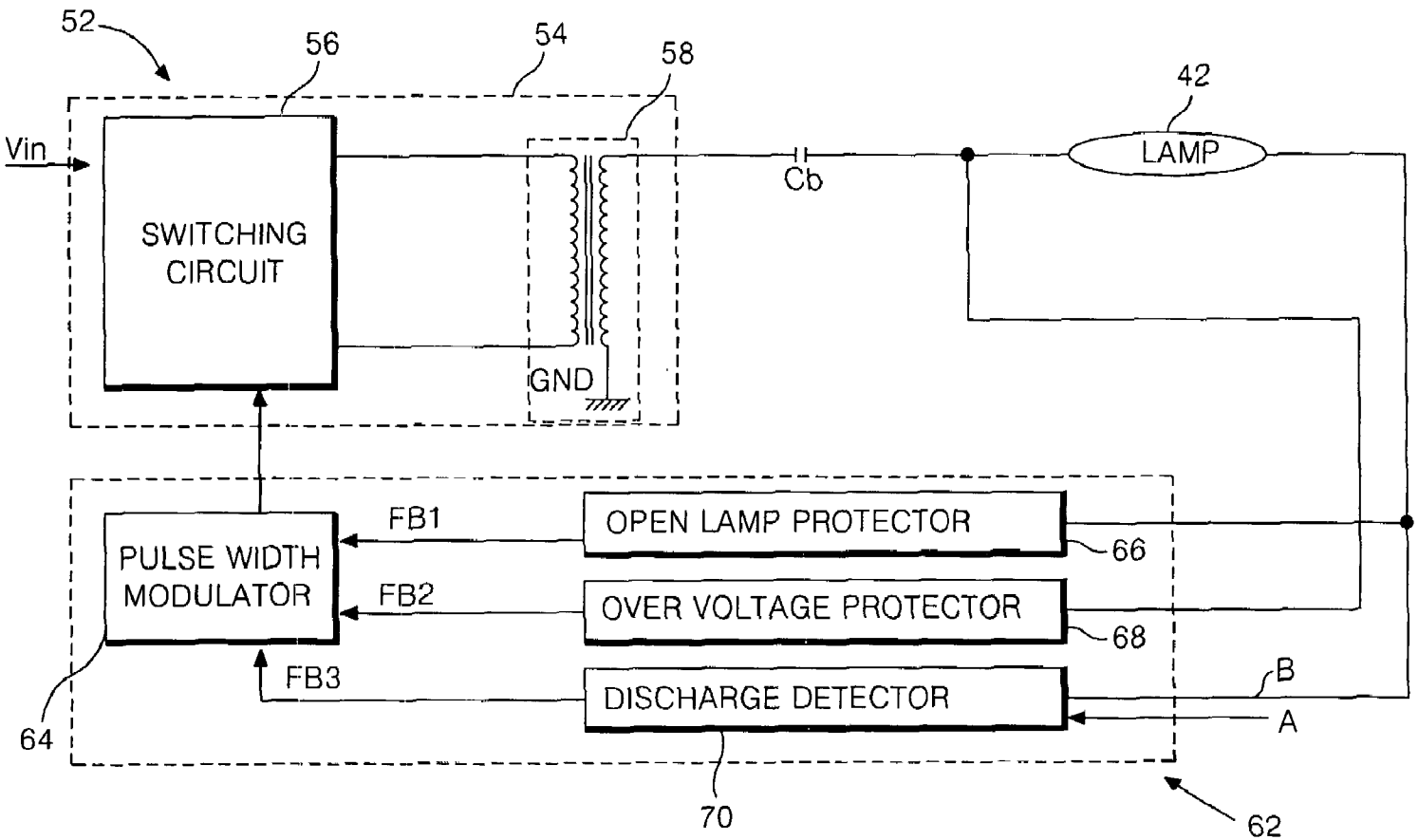
FIG. 5 is a diagram representing a lamp driving apparatus of a liquid crystal display device.
Figure 6:
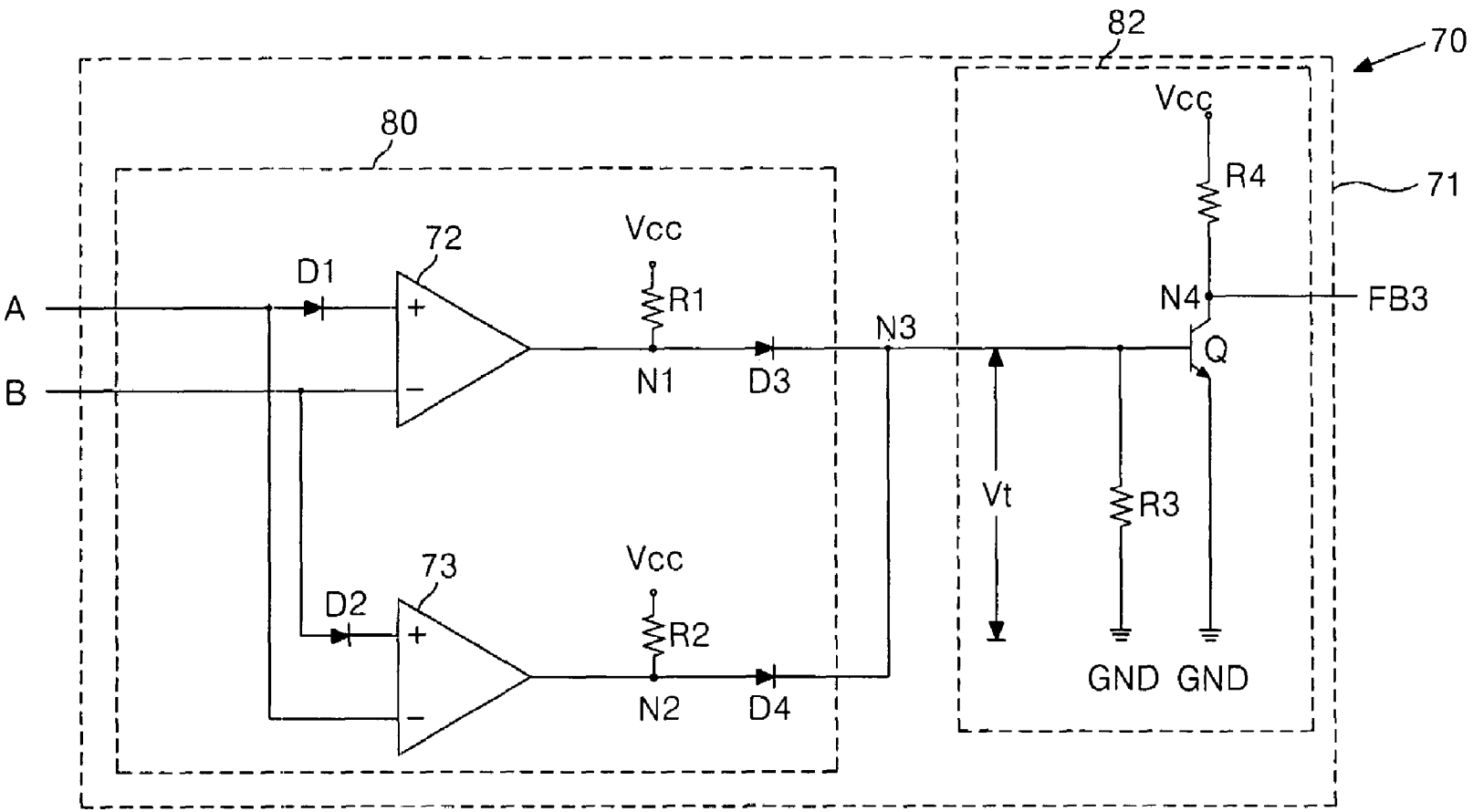
FIG. 6 is a simplified schematic diagram representing an discharge protector circuit shown in FIG. 5.

FIG. 5 is a diagram representing a lamp driving apparatus of a liquid crystal display device. FIG. 6 is a diagram of a discharge protector circuit.

A lamp apparatus of a liquid crystal display device includes a plurality of lamps 42 to generate light; an inverter part 52 with a plurality of inverters for supplying a lamp voltage to each of the lamps 42; and a lamp protector 62 to protect each of the lamps 42.

Each of the lamps 42 receives the lamp voltage from the inverter 54 and illuminates a liquid crystal display panel (not shown) with visible light. The lamps 42 arranged with a designated lamp distance L between the adjacent lamps 42.

Each inverter 54 constituting the inverter part 52 includes a switching circuit 56 to switch a voltage from a voltage source Vin in response to a switching control signal, and a transformer 58 to convert the voltage supplied by switching of the switching circuit 56 into a lamp driving voltage.

The switching circuit 56 includes at least one switching device that switches the voltage from the voltage source Vin to the transformer 58 in response to the switching control signal from a pulse width modulator 64.

The transformer 58 includes a primary winding wire connected to the switching circuit 56 and a secondary winding wire connected to the lamp 42. Both ends of the primary winding wire are connected to the switching circuit 56, one side of the secondary winding wire is connected to a first electrode terminal of the lamp 42, and the other end of the secondary winding wire is connected to a ground. The transformer 58 converts the voltage supplied to the primary winding wire by a winding ratio of the primary and secondary winding wires and induces it in the secondary winding wire. The voltage induced in the secondary winding wire is supplied to the lamp 42 through the input voltage terminal of the lamp 42 and lights the lamp 42.

The lamp protector 62 includes an open lamp protector OLP 66 to detect the presence or absence of the lamp 42 by the output voltage of the lamp 42; an over voltage protector OVP 68 to detect the situation where an over voltage supplied to the electrode part of the lamp 42 from the transformer 58; and is charge protector circuit EDP 70 to detect the situation where a mis-discharge is generated at one or more of the lamps 42; and a pulse width modulator 64 for controlling the switching period of the switching circuit 56 in response to feedback signals FB1, FB2, FB3 from the open lamp protector 66, the over voltage protector 68 and the discharge protector circuit 70.

The open lamp protector 66 detects the presence or absence of the lamp 42 by the output voltage of each of the lamp 42, to control the voltage supplied to each of the lamps 42. In the case that the lamp 42 is not present, the open lamp protector 66 generates a feedback signal FB1 corresponding to the state of the lamp output voltage. The pulse width modulator 64 inhibits the switching circuit 56 in order for the voltage from the voltage source Vin not to be supplied to the transformer 58, in accordance with the feedback signal FB1 from the open lamp protector 66. Thus, in the case where the lamp 42 is not present, the inverter 52 does not supply the voltage to the input voltage terminal of the lamp 42.

Figure 1:
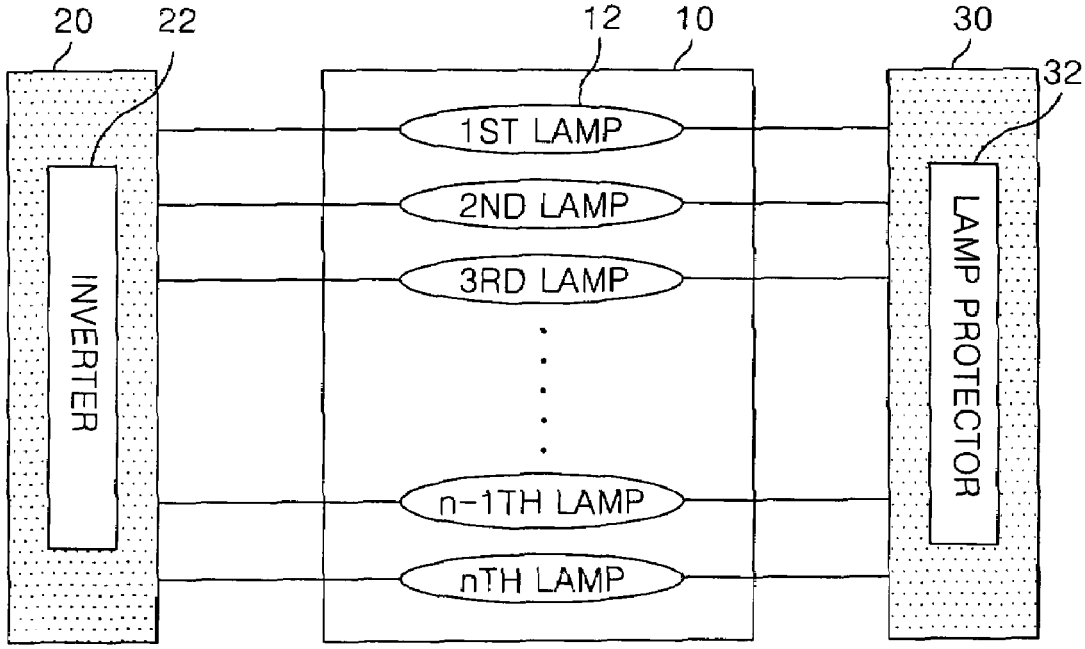
FIG. 1 RELATED ART
FIG. 1 is a diagram representing a lamp driving apparatus of a liquid crystal display.
Figure 2:
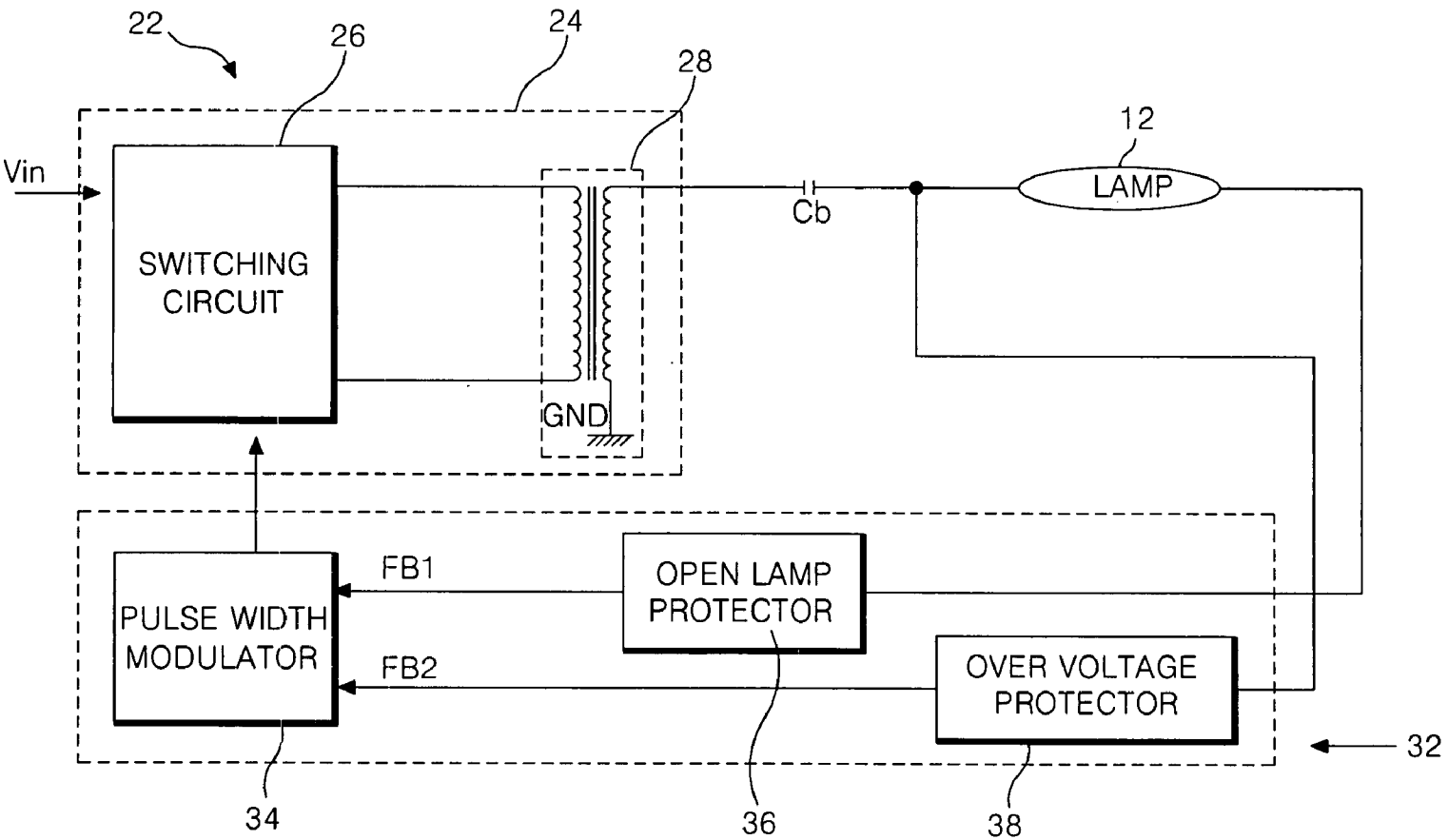
FIG. 2 RELATED ART
FIG. 2 is a diagram representing the lamp driving apparatus of the liquid crystal display shown in FIG. 1.
Figure 3:
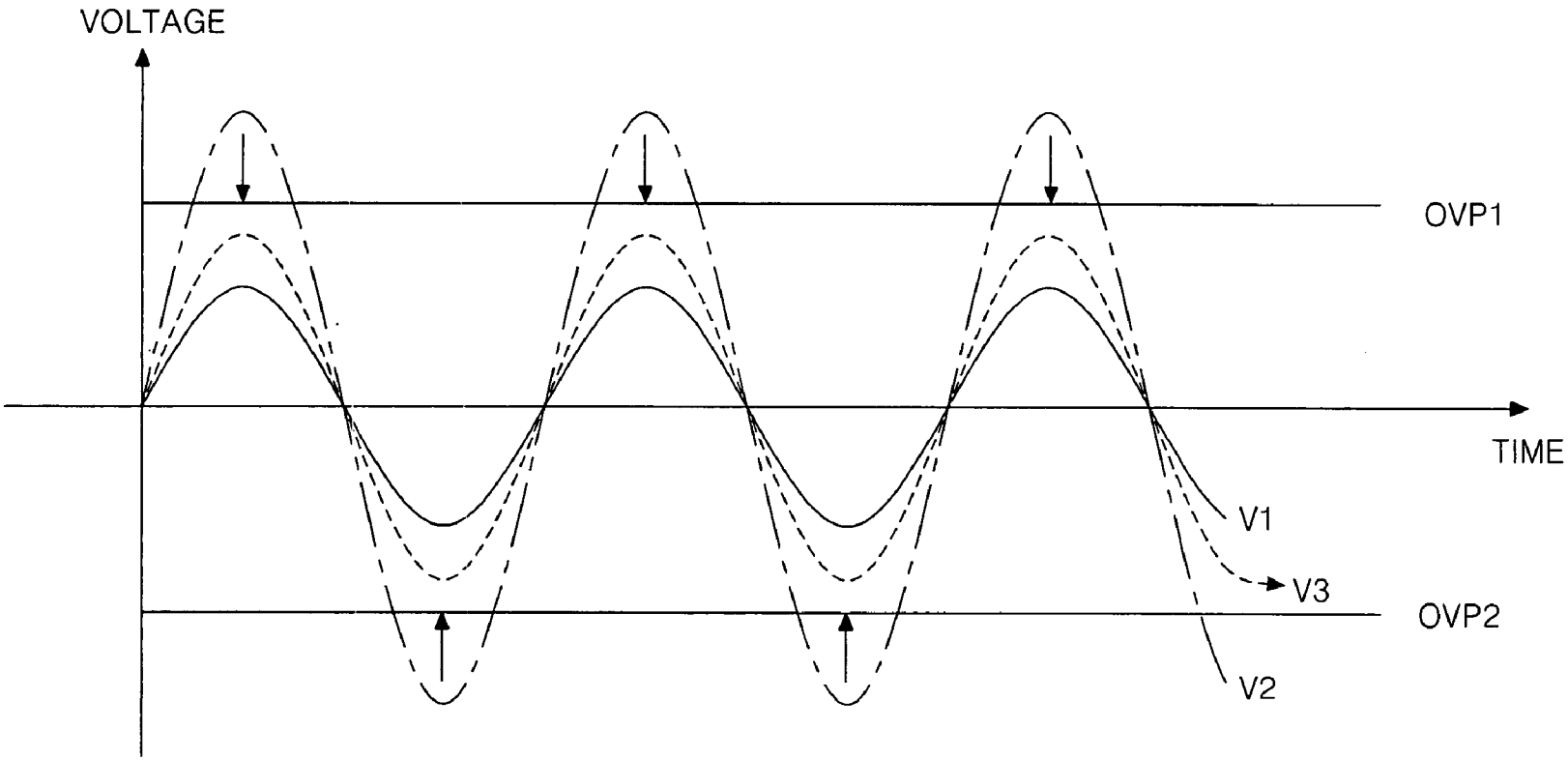
FIG. 3 RELATED ART
FIG. 3 is a diagram representing output voltage waveforms of a lamp detected by an over voltage protector shown in FIG. 1.
Figure 4:
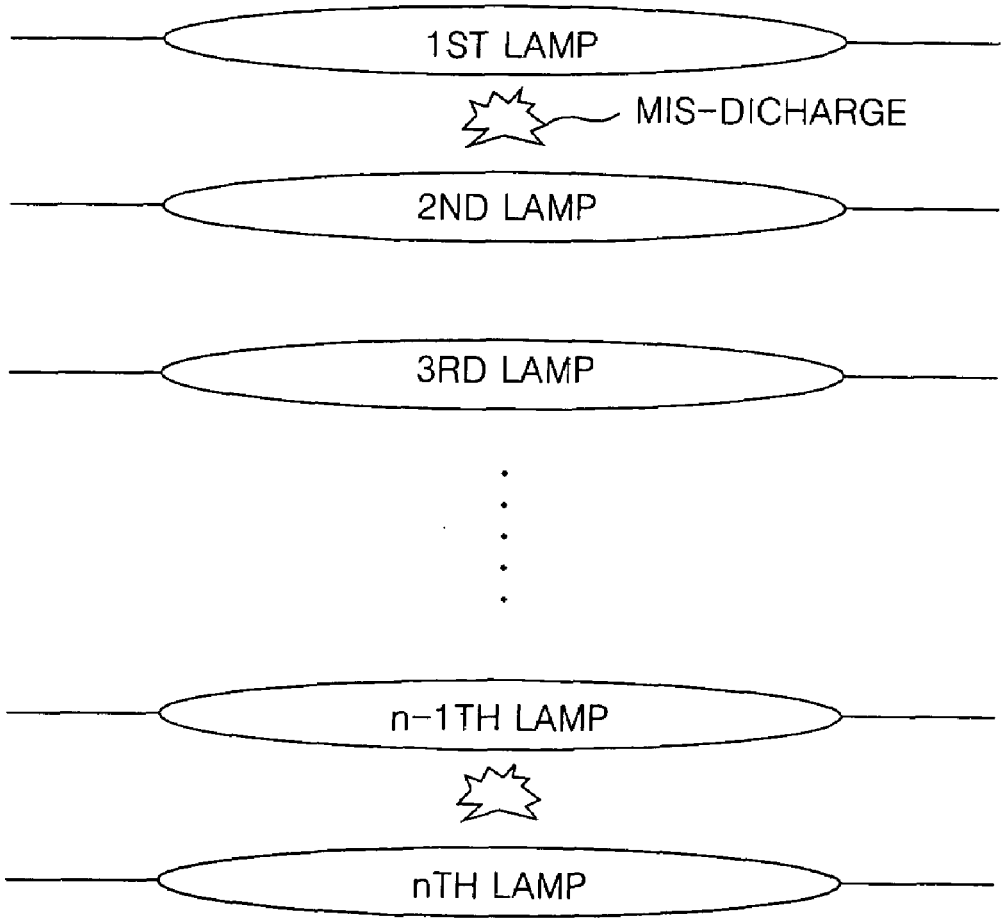
FIG. 4 RELATED ART
FIG. 4 is a diagram representing a mis-discharge generated between the lamps shown in FIG. 1.

The over voltage protector 68 detects the presence of an over voltage supplied to each of the lamps 42 from the transformer 58 to control the output voltage supplied to each of the lamps 42. More specifically, when an over voltage V2 less than or more than voltage levels OVP1, OVP2, respectively, that may cause damage to the lamp 42 as shown in FIG. 3 is supplied to the lamp 42 from the transformer 58, the over voltage protector 68 generates the feedback signal FB2 corresponding to the detected detection signal and supplies the generated signal to the pulse width modulator 64. In this circumstance, the pulse width modulator 64 controls the switching period of the switching circuit 56 by the feedback signal FB2 from the over voltage protector 68 to reduce the voltage supplied to the primary winding wire of the transformer 58 from the voltage source Vin. In this manner, the voltage V3 supplied to the lamp 42 from the secondary winding wire of the transformer 58 is reduced to prevent the lamp 42 from being damaged.

Each of discharge protectors 71 constituting the discharge protector 70 includes a comparator unit 80 to compare the output voltage of the lamps 42 and a signal generator 82 to generate a signal in accordance with the comparison result of the comparator 80.

Figure 7:
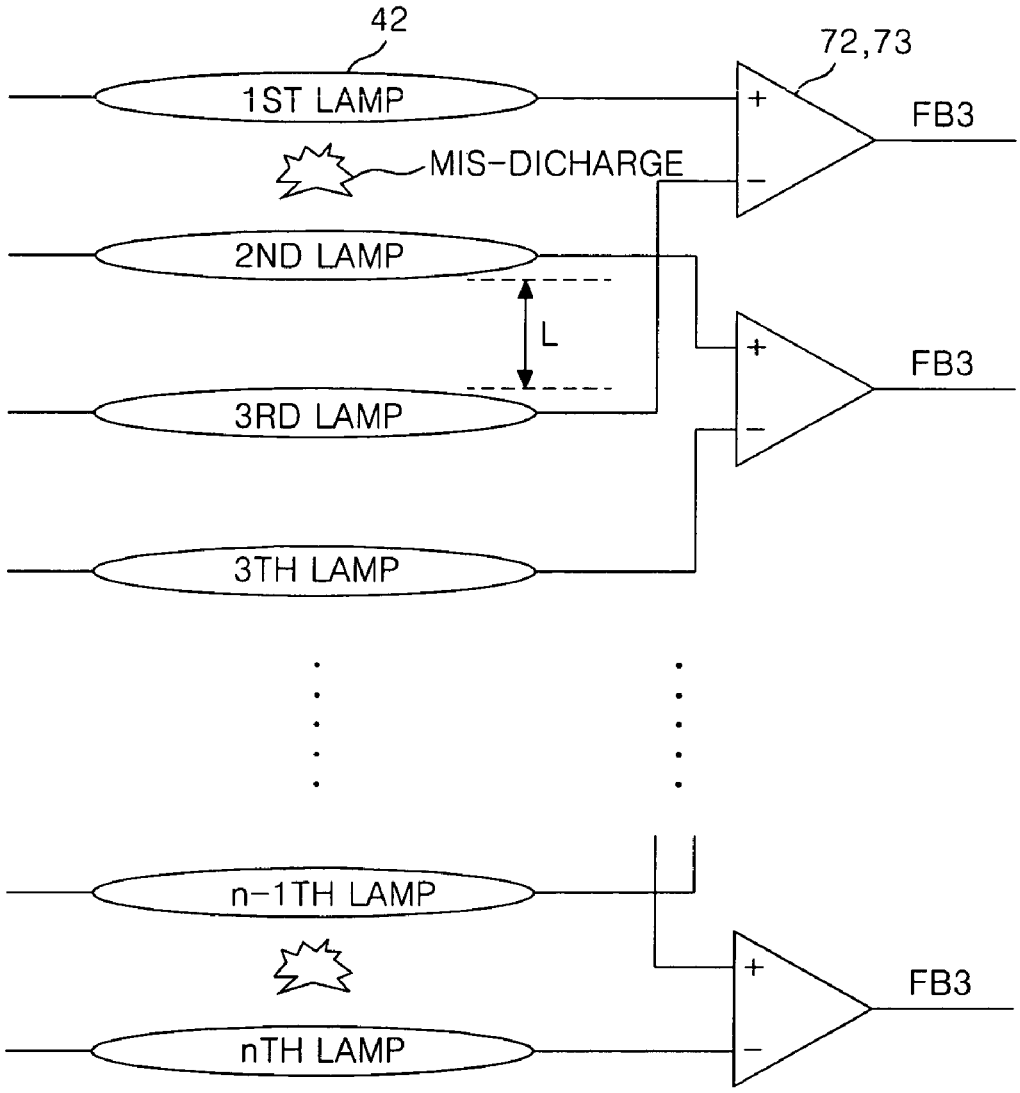
FIG. 7 is a diagram representing a method of comparing output voltages of lamps at a comparator unit shown in FIG. 6.

The comparator unit 80 compares the output voltages A, B of the lamps 42, which are each arranged with a lamp distance L from the adjacent lamps 42 as shown in FIG. 7. More specifically, the output voltage of a lamp 42 arranged at an even-numbered location among the lamps 42 may be inputted to first terminal (+) of comparator 72 and the second terminal (−) of comparator 73; the output voltage of the lamp arranged at another of the even-numbered locations, is inputted to second terminal (−) of the comparator 72 and the first terminal (+) of comparator 73. In addition, the output voltage of a lamp 42 arranged at an odd-numbered location, among the lamps 42 may be inputted to the first terminals (+) of other comparators 72 and the second terminal of (−) of comparators 73; the output voltage of the lamp 42 arranged at another the odd-numbered location, may be is inputted to the second terminal (−) of comparators 72, and also inputted to first terminal (+) of the comparators 73.

Figure 8:
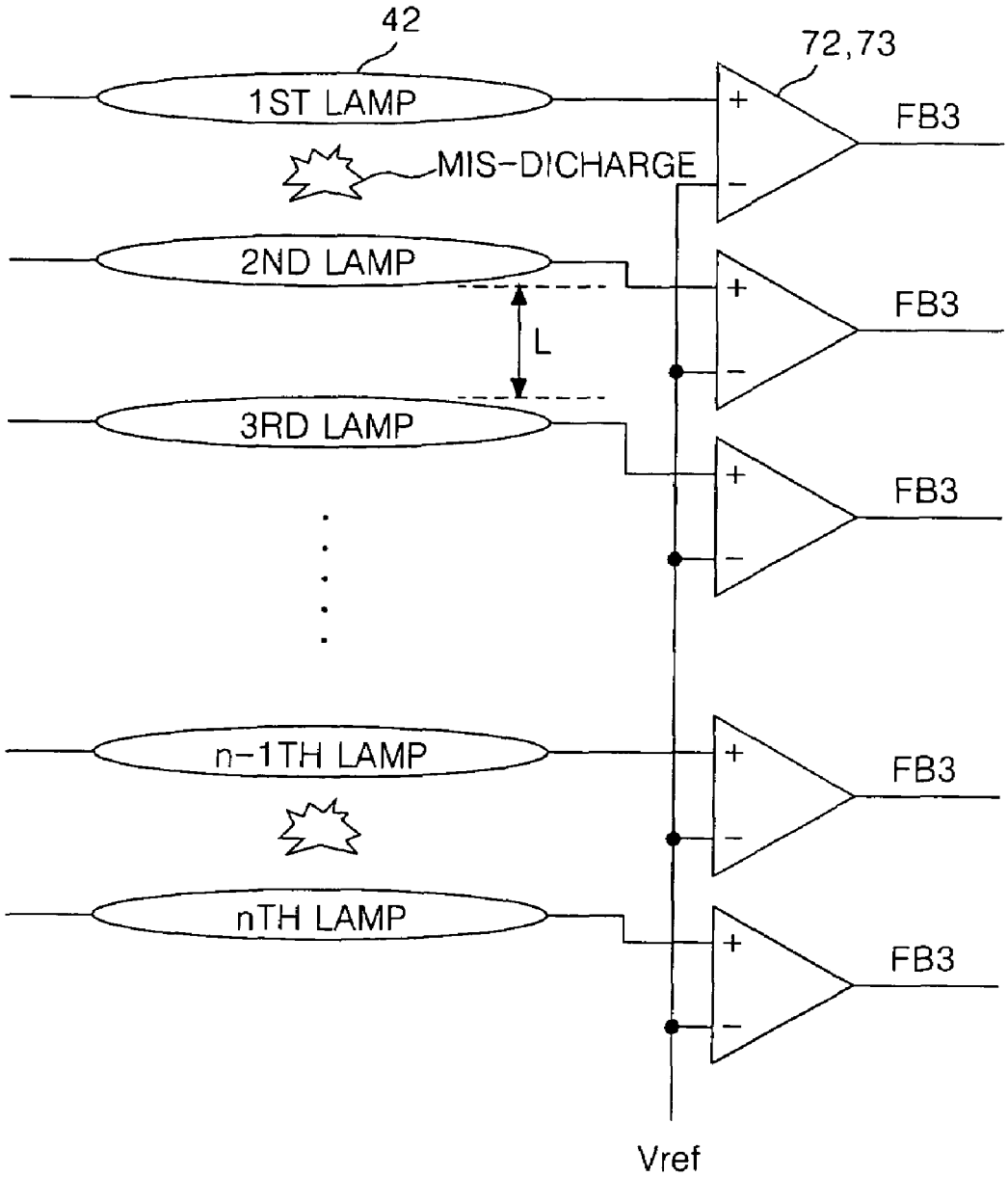
FIG. 8 is a diagram representing another method of comparing the output voltages of the lamps at a comparator unit shown in FIG. 6.

In another aspect, the comparators 72 and 73, as shown in FIG. 8, compares a reference voltage Vref, which may be for driving the lamps 42, with the output voltage of the lamps 42. For this, the comparator unit 80 includes the comparators 72, 73 to compare the output voltages of the lamps 42; a driving power source Vcc to drive the lamp protector 62; a first resistor R1 and a second resistor R2 installed between the driving power source Vcc and the comparators 72, 73; a first diode D1 and a second diode D2 installed first terminals (+) of the comparators 72, 73 to prevent a reverse current from the comparators 72, 73; and a third diode D3 and a fourth diode D4 installed between the comparators 72, 73 and the signal generator 82 to prevent a reverse current from the signal generator 82.

The signal generator 82 generates a feedback signal FB3 in accordance with the output value of the comparator unit 80 and supplies the feedback signal FB3 to the pulse width modulator 64. That is, the output value of the comparator 80 is high (1) when no mis-discharge is generated at the lamps, and the signal generator 82 generates a feedback signal FB3 of low (0). The output value of the comparator 80 is low (0) when a mis-discharge is generated at any one lamp among the lamps 42, and the signal generator 82 generates a feedback signal FB3 of high (1). In this circumstance, when the feedback signal FB3 of high (1) is supplied to the pulse width modulator 64, the pulse width modulator 64 cuts off the switching circuit 56 to interrupt the power supplied to the lamp 42 where the mis-discharge is generated. For generating the feedback signal FB3, the signal generator 82 is installed between the driving power source Vcc and the ground and includes a transistor Q operated in accordance with the output signal of the comparator 80, a third resistor R3 installed between the comparator 80 and the ground, and a fourth resistor R4 installed between the driving power source Vcc and the transistor Q.

The pulse width modulator 64 controls the switching period of the switching circuit 56 in response to the feedback signals FB1, FB2, FB3 from the open lamp protector 66, the over voltage protector 68 and the discharge protector circuit 70. That is, the pulse width modulator 64 controls the voltage supplied to the transformer 58 by controlling the switching period of the switching device, which constitutes the switching circuit 56 in response to the feedback signals FB1, FB2 and FB3. In this way, the signal generator 82 of the discharge protector circuit 70 and the pulse width modulator 64 plays the role of a power interrupter, which cuts off the power supply of the lamp 42 where the mis-discharge is generated, in response to the feedback signal FB3 generated in accordance with the comparison result after comparing tube currents or the output voltages of the lamps 42.

More specifically, the voltage from the voltage source Vin is supplied to the primary winding wire of the transformer 58 by switching the switching circuit 56 that is controlled by the pulse width modulator 64 of the lamp protector 62. The voltage supplied to the primary winding wire of the transformer 58 is converted by the winding ratio of the primary and secondary winding wires of the transformer 58 and induced on the secondary winding wire. The induced voltage on the secondary winding wire of the transformer 58 is supplied to the first electrode terminal of the lamp 42 to light the lamp 42. If the lamp 42 is not present, the open lamp protector 66 may supply the feedback signal FB1 of low (0) to the pulse width modulator 64 to cut off the switching circuit 56. Because of this, the voltage from the voltage source Vin is prevented from being supplied to the primary winding wire of the transformer 58 to interrupt the power supply to the electrode part of the lamp 42.

If the lamp 42 is present, the voltage induced on the secondary winding wire of the transformer 58 is supplied to the first electrode terminal to light the lamp 42. If the lamp 42 is lit, the over voltage protector 68 detects the output voltage of the lamp 42. If the output voltage of the lamp 42, as shown in FIG. 3, is present between the voltages OVP1, OVP2, respectively (V1), and will not damage the lamp 42, the over voltage protector 68 supplies the feedback signal FB2 of high (1) to the pulse width modulator 64. The feedback signal FB2 supplied to the pulse width modulator 64 causes the switching period of the switching circuit to remain at the same state as previous state and sustain the voltage supplied to the primary winding wire of the transformer 58 from the voltage source Vin. However, if the voltage detected at the over voltage protector 68 is not less than or more than the voltages OVP1, OVP2, respectively (V2), and may cause damage to the lamp 42, the over voltage protector 68 supplies the feedback signal FB2 of low (0) to the pulse width modulator 64. The feedback signal FB2 supplied to the pulse width modulator 64 reduces the switching period of the switching circuit 56 to reduce the voltage supplied to the primary winding wire of the transformer 58 from the voltage source Vin, such that the output voltage is V3.

Figure 9:
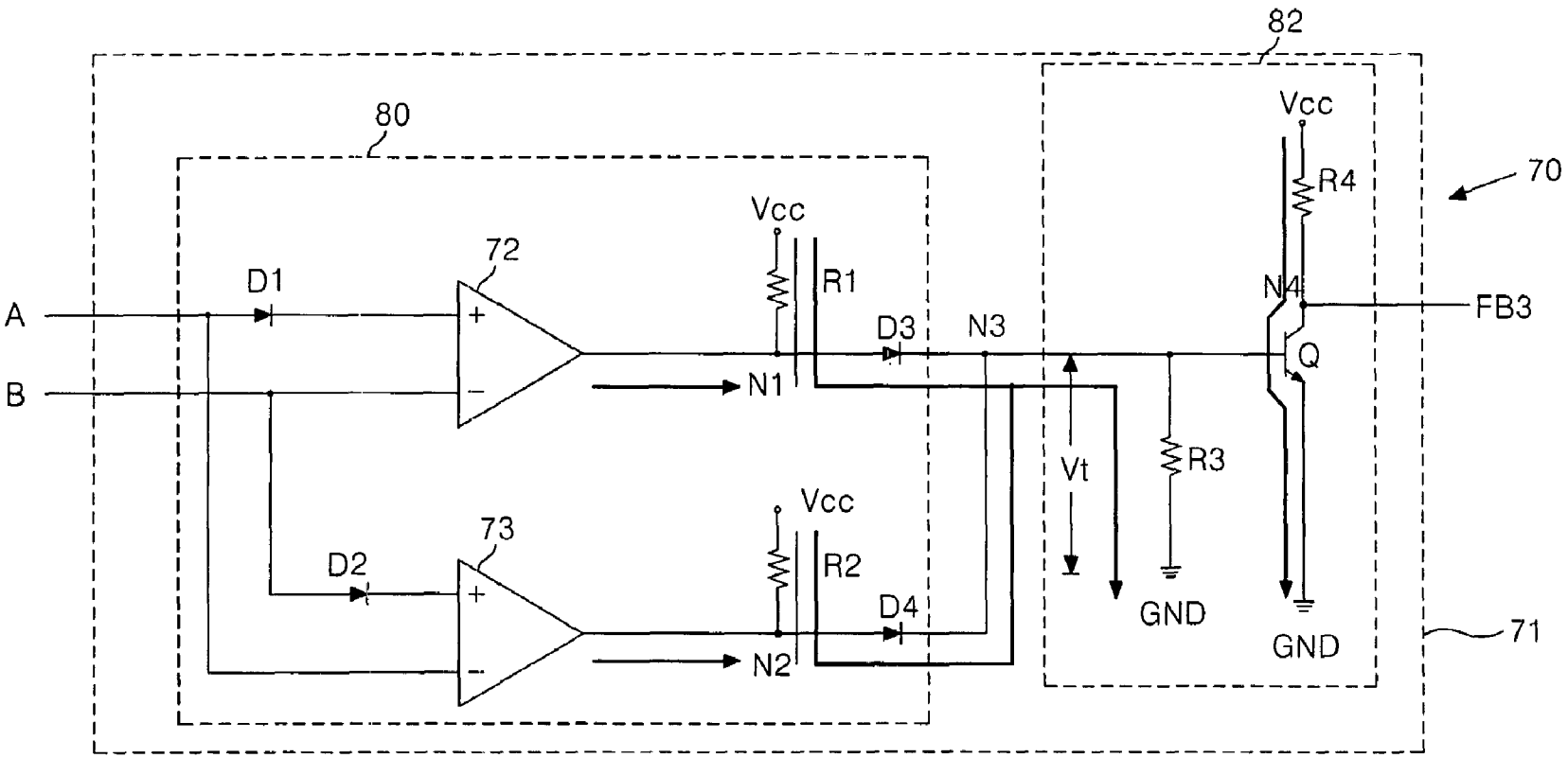
FIG. 9 is a diagram representing the operation of the discharge protector circuit when no mis-discharge occurs.
Figure 10:
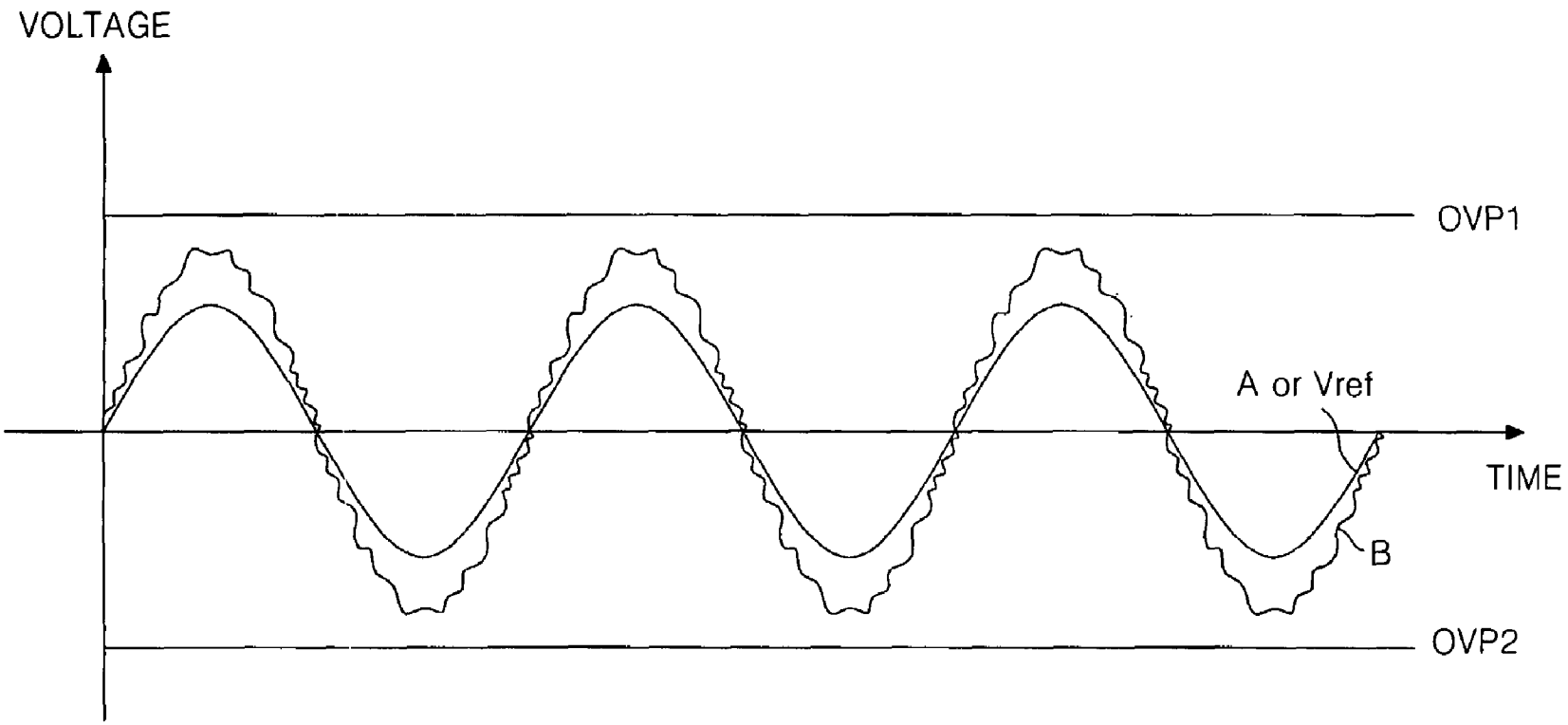
FIG. 10 is a diagram representing a discharge waveform detected at the discharge protector shown in FIG. 6.
Figure 11:
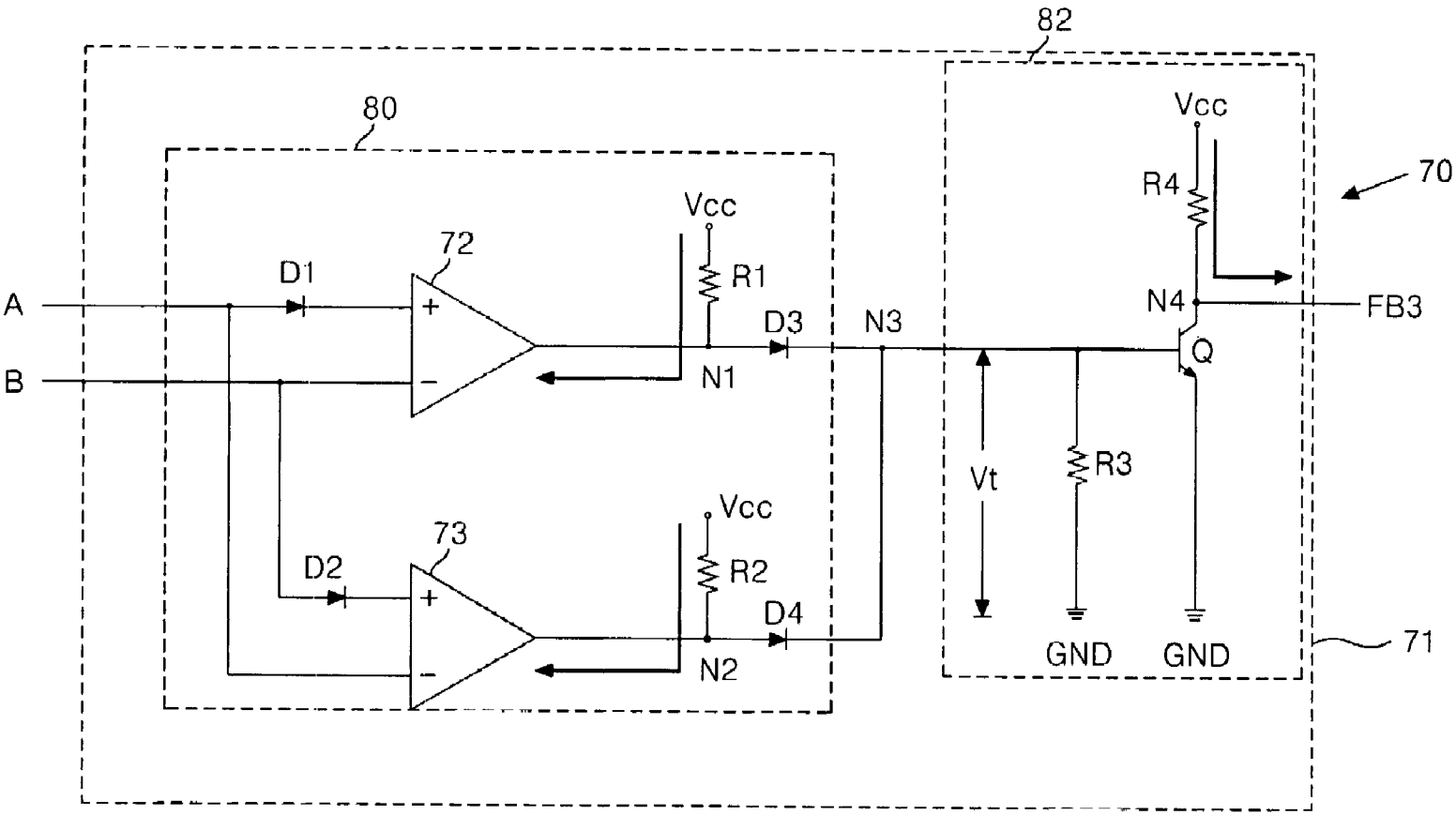
FIG. 11 is a diagram representing the operation of the discharge protector circuit when a mis-discharge occurs between lamps.

When the lamp 42 is lit, the discharge protector 70 compares the output voltages A, B of the lamps 42 or tube currents of the lamps 42 between the lamps 42 separated by more than a predetermined lamp distance L among the lamps 42 that are arranged with the predetermined lamp distance L from the adjacent lamps 42. In this circumstance, the output voltage A, B of the lamp 42 inputted to the comparator 80 is inputted to the input terminals of the comparators 72, 73. If the output value of the comparator unit 80 is high (1), i.e., if no mis-discharge is generated at the lamps 42, the current value (or voltage value) on a first node N1 and a second node N2 by the driving power source Vcc, as shown in FIG. 9, is transmitted to the ground through the third resistor R3 after being added at the third node N3 through the third diode D3 and the fourth diode D4. That is, the comparator unit 80 transmits the output signal of high (1) to the signal generator 82. The output signal transmitted to the signal generator 82 forms a turn-on voltage Vt at the third resistor R3 to turn on the transistor Q. If the transistor Q is turned on, the current value (or voltage value) on the fourth node N4 by the current value (or voltage value) supplied from the driving power source Vcc is transmitted to ground through the transistor Q. As a consequence, the signal generator 82 supplies the feedback signal FB3 of low (0) to the pulse width modulator 64, and the pulse width modulator 64 supplies the pulse of previous state to the switching circuit 56, thereby supplying the output voltage of the previous state to the lamps 42. However, if the output value of the comparator 80 is low (0), i.e., as shown in FIG. 10, when a mis-discharge is generated at any one lamp 42 among the lamps 42 by the voltage that lies between the voltages OVP1 and OVP2, the current value (or voltage value) on the first node N1 and the second node N2 by the driving power source Vcc forms a virtual closed loop with the second terminal (−) of the comparators 72, 73 as shown in FIG. 11. That is, the comparator unit 80 supplies the output signal of low (0) to the signal generator 82. In this circumstance, the signal supplied to the signal generator 82 causes current not to flow in the third resistor R3 of the signal generator 82, thus no turn-on voltage Vt is formed. If the turn-on voltage Vt is not formed, the transistor Q is turned off and the output terminal of the signal generator 82 outputs the voltage value supplied from the driving power source Vcc through the fourth resistor R4. That is, the signal generator 82 supplies the feedback signal FB3 of high (1) to the pulse width modulator 64. The pulse width modulator 64 cuts off the switching circuit 56 so that voltage is not supplied to the primary winding wire of the transformer 58 from the voltage source Vin. Thus, the power supplied to the electrode part of the lamp 42 where mis-discharge is generated is interrupted to protect the lamp 42 where mis-discharge is generated.

In another aspect, the discharge protector circuit 70 compares the reference voltage Vref with the output voltage of the lamps as shown in FIG. 8. This comparison may be made in the same manner as previously described and thus further detailed description is omitted.

As described above, the lamp driving apparatus of the liquid crystal display device according to an embodiment of the present invention detects the mis-discharge generated at the lamp to interrupt the power supply of the lamp where the mis-discharge is generated, thereby preventing the damage of the lamp where the mis-discharge is generated. Thus, the output voltage of the inverter supplied to the lamps is stabilized to enable it to improve the reliability and stability of the lamp electrode part.

Although the present invention has been explained by way of the embodiments described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A lamp unit of a display, comprising:

a housing adapted to receive a plurality of lamps arranged with a predetermined distance L between adjacent lamps, and having a power supply and an output voltage connection for each lamp;

a comparator unit to compare output voltages of lamps that are separated by a distance greater than or equal to an integer multiple of L, where the integer is at least 2; and a power interrupter to interrupt the power supply to one of the compared lamps, in accordance with a comparison result.

2. A lamp driving apparatus, comprising:

a plurality of lamps arranged with a predetermined distance between adjacent lamps;

a power supply to supply power to each of the plurality of lamps;

a comparator unit to compare the output voltage of a first lamp of the plurality of lamps with a reference voltage and produce a comparison result;

an inverter to supply a driving voltage to the lamps(or the plurality of lamps);

an open lamp protector to detect the presence or absence of the first lamp according to the output voltage of the first lamp;

an over voltage protector to detect an over voltage supplied to the first lamp according to the output voltage of the first lamp;

a signal generator to generate a feedback signal in accordance with the comparison result of the comparator unit; and a pulse width modulator having a switching circuit, a period of the switching circuit controlled in accordance with the feedback signal of the signal generator.

3. A lamp driving apparatus, comprising:

a plurality of lamps arranged with a predetermined distance between adjacent lamps;

a power supply to supply power to each of the plurality of lamps;

a comparator unit to compare the output voltage of a first lamp of the plurality of lamos with a reference voltage and produce a comparison result; and a power interrupter to cut off the power supply of the first lamp when a mis-discharge is generated, in accordance with the comparison result, wherein the reference voltage is an output voltage of a second lamp of the plurality of lamps.

4. The lamp driving apparatus according to claim 3, wherein the first and second lamps are disposed at even-numbered locations among the plurality of lamps.

5. The lamp driving apparatus according to claim 3, wherein the first and second lamps are disposed at odd-numbered locations among the plurality of lamps.

6. The lamp driving apparatus according to claim 3, wherein the comparator unit comprises:

a first comparator of which a first terminal receives the output voltage of a first lamp of the plurality of lamps and a second terminal receives the output voltage of a second lamp of the plurality of lamps, the second lamp not adjacent to the first lamp;

a second comparator of which a third terminal receives the output voltage of the second lamp and a fourth terminal receives the output voltage of the first lamp;

a first diode disposed between the first lamp and the first terminal of the first comparator;

a second diode disposed between second lamp and the third terminal of the second comparator;

a third diode disposed between an output of the first comparator and the power interrupter;

a fourth diode disposed between an output of the second comparator and the power interrupter;

a driving power source to drive the first and second comparator and the power interrupter;

a first resistor disposed between the driving power source and an anode of the third diode; and a second resistor disposed between the driving power source and an anode of the fourth diode.

7. The lamp driving apparatus according to claim 3, further comprising:

an inverter to supply a driving voltage to the lamps(or the plurality of lamps);

an open lamp protector to detect the presence or absence of the first lamp according to the output voltage of the first lamp; and an over voltage protector to detect an over voltage supplied to the first lamp according to the output voltage of the first lamp.

8. The lamp driving apparatus according to claim 7, wherein the inverter includes:

a transformer to convert a voltage from a voltage source to the driving voltage; and a switching circuit to switch the voltage to the transformer.

9. The lamp driving apparatus according to claim 3, wherein the power interrupter comprises:

a signal generator to generate a feedback signal in accordance with the comparison result of the comparator unit; and a pulse width modulator having a switching circuit, a period of the switching circuit controlled in accordance with the feedback signal of the signal generator.

10. The lamp driving apparatus according to claim 9, wherein the signal generator comprises:

a third resistor disposed between the comparator unit and a ground;

a transistor installed between a driving power source and the ground to operate in accordance with the comparison result of the comparator unit; and a fourth resistor installed between a transistor and the driving power source.

11. A lamp apparatus of a display, comprising:

a plurality of lamps arranged with a predetermined distance L between adjacent lamps, the lamps adapted to receive power from a power supply;

a comparator unit to compare output voltages of lamps that are separated by a distance greater than or equal to an integer multiple of L, where the integer is at least 2;

an inverter to supply a driving voltage to the lamps;

an open lamp protector to detect the presence or absence of each of the lamps according to the output voltage of each of the lamps;

an over voltage protector to detect an over voltage supplied to each of the lamps according to the output voltage each of the lamps;

a signal generator to generate a feedback signal in accordance with the comparison result of the comparator unit; and a pulse width modulator having a switching circuit, a period of the switching circuit controlled in accordance with the feedback signal of the signal generator.

12. A lamp driving method of a display containing a plurality of lamps, the method comprising:

comparing a reference voltage with output voltages of the lamps; and interrupting a power supply to one of the plurality of lamps in accordance with comparison results, wherein the reference voltage is an output voltage of one of the lamps.

13. The lamp driving method according to claim 12, wherein the lamps compared are disposed at odd-numbered locations among the plurality of lamps.

14. The lamp driving method according to claim 12, wherein the lamps compared are disposed at even-numbered locations among the plurality of lamps.

* * * * *

UNITED STATES PATENT AND TRADEMARK OFFICE

CERTIFICATE OF CORRECTION

PATENT NO. : 7,372,214 B2
APPLICATION NO. : 11/013871
DATED : May 13, 2008
INVENTOR(S) : Jae Hun Song et al.

It is certified that error appears in the above-identified patent and that said Letters Patent is hereby corrected as shown below:

On the Title Page

In column 1, item (75), after "Lee," delete "Daegu" and substitute --Dong-ku-- in its place.

On page 2, column 2, line 4, delete "9/2000" and substitute --9/2002-- in its place.

In the Claims

Column 9, in claim 3, line 7, after "the plurality of" delete "lamos" and substitute --lamps-- in its place.

Signed and Sealed this

Second Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,372,214 B2
APPLICATION NO. : 11/013871
DATED : May 13, 2008
INVENTOR(S) : Jae Hun Song et al.

It is certified that error appears in the above-identified patent and that said Letters Patent is hereby corrected as shown below:

On the Title Page

In column 1, item (75), after "Lee," delete "Daegu" and substitute --Dong-ku-- in its place.

On page 2, column 2, line 4, delete "9/2000" and substitute --9/2002-- in its place.

In the Claims

Column 9, in claim 3, line 38, after "the plurality of" delete "lamos" and substitute --lamps-- in its place.

This certificate supersedes the Certificate of Correction issued September 2, 2008.

Signed and Sealed this

Thirtieth Day of September, 2008

JON W. DUDAS
*Director of the United States Patent and Trademark Office*